US010942016B2

(12) United States Patent
Olivares et al.

(10) Patent No.: US 10,942,016 B2
(45) Date of Patent: Mar. 9, 2021

(54) DETONATOR PACKAGING SYSTEM AND METHOD

(71) Applicant: Dyno Nobel Inc., Salt Lake City, UT (US)

(72) Inventors: Cesar A. Olivares, Lampa (CL); Leonardo G. Rivera, West Hartford, CT (US); J. Donaldson Thomas, Simsbury, CT (US)

(73) Assignee: DYNO NOBEL INC., Salt Lake City, UT (US)

( * ) Notice: Subject to any disclaimer, the term of this patent is extended or adjusted under 35 U.S.C. 154(b) by 221 days.

(21) Appl. No.: 15/564,634

(22) PCT Filed: Apr. 13, 2016

(86) PCT No.: PCT/US2016/027236
§ 371 (c)(1),
(2) Date: Oct. 5, 2017

(87) PCT Pub. No.: WO2016/168265
PCT Pub. Date: Oct. 20, 2016

(65) Prior Publication Data

US 2018/0080750 A1 Mar. 22, 2018

Related U.S. Application Data

(60) Provisional application No. 62/146,506, filed on Apr. 13, 2015.

(51) Int. Cl.
*F42B 39/30* (2006.01)
*B65D 85/30* (2006.01)
(Continued)

(52) U.S. Cl.
CPC ..... *F42B 39/30* (2013.01); *B65B 27/06* (2013.01); *B65D 79/00* (2013.01); *B65D 85/04* (2013.01);
(Continued)

(58) Field of Classification Search
CPC ..... F42B 39/30; F42B 39/14; B65B 27/06; B65D 79/00; B65D 85/04; B65D 85/02; B65D 85/00; B65D 85/30
See application file for complete search history.

(56) References Cited

U.S. PATENT DOCUMENTS 1,631,756 A 6/1927 Olin
2,136,031 A 11/1938 Stuart
(Continued)

FOREIGN PATENT DOCUMENTS

CL 199400212 1/1995
RU 2320954 C2 3/2008

OTHER PUBLICATIONS

International Search Report for international application PCT/US2016/027236, international filing date of Apr. 13, 2016, dated Jul. 15, 2016, 8 pages.
(Continued)

*Primary Examiner* — Steven A. Reynolds
*Assistant Examiner* — Javier A Pagan
(74) *Attorney, Agent, or Firm* — Cantor Colburn LLP

(57) ABSTRACT

A packaging system includes a container (34) within which are disposed first detonator devices (10) having reactive coils (16), e.g., coils of shock tube leads, and second detonator devices (20) having inert coils (26), e.g., coils of insulated electric leg wires. The inert coils (26) are interposed between the reactive coils (16) and are approximately co-extensive with the reactive coils (16), so that the inert coils (26) form a barrier to propagation of an accidental
(Continued)

initiation from one reactive coil (16) to another. Reactive coils (16) and inert coils (26) are fastened to each other to form mixed coil pairs (30) which are nested to interpose a pair of the inert coils (26) between at least some of the reactive coils (16). A method of packing the first and second detonator devices calls for placing them in a container (34) in the described arrangement.

3 Claims, 4 Drawing Sheets

(51) Int. Cl.

| | |
|---|---|
| ***B65D 85/04*** | (2006.01) |
| ***F42B 3/00*** | (2006.01) |
| ***B65B 27/06*** | (2006.01) |
| ***B65D 79/00*** | (2006.01) |
| ***F42B 39/14*** | (2006.01) |

(52) U.S. Cl.
CPC ..... *B65D 85/30* (2013.01); *F42B 39/14* (2013.01); *B65D 2585/86* (2013.01); *F42B 3/00* (2013.01)

(56) References Cited

U.S. PATENT DOCUMENTS

| | | | | | |
|---|---|---|---|---|---|
| 2,352,998 | A | * | 7/1944 | Alexander | F42B 39/30 206/3 |
| 2,601,919 | A | | 7/1952 | Darbyshire | |
| 2,717,551 | A | | 9/1955 | Blackburn et al. | |
| 2,868,360 | A | | 1/1959 | Donkin | |
| 4,222,484 | A | | 9/1980 | Howe | |
| 4,286,708 | A | | 9/1981 | Porzel | |
| 4,440,296 | A | | 4/1984 | Howe et al. | |
| 4,586,602 | A | | 5/1986 | Levey | |
| 5,127,593 | A | * | 7/1992 | Gaston | F42B 39/30 242/159 |
| 5,129,514 | A | | 7/1992 | Lilley, Jr. | |
| 5,494,152 | A | * | 2/1996 | Sobczak | B65B 23/00 102/202.12 |
| 5,585,591 | A | * | 12/1996 | Waldock | F42B 39/30 102/202.12 |
| 8,006,622 | B2 | | 8/2011 | Munoz Saldarriaga et al. | |

OTHER PUBLICATIONS

Written Opinion for international application PCT/US2016/027236, international filing date of Apr. 13, 2016, dated Jul. 15, 2016, 4 pages.

* cited by examiner

DETONATOR PACKAGING SYSTEM AND METHOD

CROSS-REFERENCE TO RELATED APPLICATION APPLICATIONS

This application is a U.S. national stage application of International Application No. PCT/US2016/027236 entitled "DETONATOR PACKAGING SYSTEM AND METHOD", which has an international filing date of 13 Apr. 2016, and which claims priority of U.S. provisional patent application Ser. No. 62/146,506 filed on Apr. 13, 2015 in the name of Cesar A. Olivares et al. and entitled "Detonator Packaging System and Method".

BACKGROUND OF THE INVENTION

Field of the Invention

The present invention relates to packaging systems and methods for packaging and shipping detonators.

The need to transport commercial quantities of explosive initiating devices comprising detonators ("detonator devices") of course gives rise to safety concerns during packing, storing and shipping of the detonator devices. The packages may be exposed to a wide range of temperatures and a variety of physical stresses during shipment and handling. In designing a packaging system for detonators, attention must be given not only to preventing unwanted detonation of the detonators in the package during shipment and handling, but also to limit or prevent the propagation of such unwanted detonation from one detonator device to another within a container and from one container to another. The prior art generally addresses these concerns through the use of dense packaging materials and by disposing detonators singly in isolated compartments.

Description of Related Art

U.S. Pat. No. 5,494,152 to Sobczak et al. dated Feb. 27, 1996 discloses a packaging system for detonator devices comprising a plurality of subpack containers disposed in an overpack container, and an overpack pad disposed between adjacent subpack containers.

U.S. Pat. No. 2,868,360 to Donkin dated Jan. 13, 1959 discloses a storage container for detonators in which an outer box is divided by an interior partition into two main compartments, and wherein each compartment is divided into cells by a separator assembly. A single detonator is disposed within each cell.

U.S. Pat. No. 2,601,919 to Darbyshire dated Jul. 1, 1952 discloses a container for packaging electrical detonators comprising an outer box that holds a plurality of compartmentalized inner boxes. Each compartment is dimensioned and configured to hold a single detonator and associated leg wires.

U.S. Pat. No. 2,352,998 to Alexander et al. dated Jul. 4, 1944 discloses a packaging system for electrical blasting caps and their associated leg wires in which each cap and its leg wire is disposed within a cardboard tube, and a plurality of the tubes is contained within a box.

U.S. Pat. No. 1,631,756 to Olin dated Jun. 7, 1927 discloses a tube arrangement for packaging a single detonator.

U.S. Pat. No. 4,586,602 to Levey dated May 6, 1986 shows a transport system for transporting detonating cord in which the detonating cord is looped around cardboard support members and packed in a cardboard box surrounded by cardboard baffles.

The Applicant and its predecessor in interest have previously used a packaging system comprising an overpack container within which was disposed a plurality of subpack containers, each subpack container holding a plurality of unsegregated identical detonator devices.

SUMMARY OF THE INVENTION

Generally, in accordance with the present invention there is provided a packaging system for storing and transporting in a single container two types of detonator devices, one type having leads which contain explosive or combustible, that is, energetic, material ("reactive leads") and the other type having leads which do not contain reactive material ("inert leads"). For packaging and shipping the detonator devices, the leads are coiled and one or more easily removable bands, such as paper or cardboard bands, are used to hold the leads in their coiled configuration. The invention provides for packaging the two types of detonator devices with coiled inert leads interposed between coiled reactive leads in order to interrupt, or at least increase the chance of interrupting, propagation of accidental initiation of reactive leads from one coiled reactive lead to another. Reactive leads, such as shock tube or safety fuse, are used for non-electric detonators, and inert leads, such as electric-conducting leg wires, are used for electric detonators. Both non-electric and electric detonators may include either a pyrotechnic or electronic delay timing mechanism.

For economy of expression, in the claims and sometimes below, reactive lead coils, that is, coils of reactive leads, are referred to as "reactive coils" or "reactive coil" and inert lead coils, that is, coils of inert leads, are referred to as "inert coils" or "inert coil".

Specifically, in accordance with the present invention there is provided a packaging system comprising a container within which are disposed a plurality of first detonator devices comprising detonators having reactive coils attached thereto, and a plurality of second detonator devices respectively comprising detonators having inert coils attached thereto. The first and second detonator devices are disposed within the container so that at least some of the reactive coils have interposed between them inert coils, the inert coils thereby providing barriers of inert coils between at least some of the reactive coils.

Other aspects of the packaging system of the present invention provide for one or more of the following additional features in any suitable combination. The barriers of inert coils may be substantially co-extensive in length and width with the reactive coils; the inert coils and the reactive coils may be of approximately the same length and width; the reactive coils may be larger than the inert coils and individual barriers may be comprised of a plurality of the inert coils, for example, two inert coils; the packaging system may comprise abutting pairs of the reactive coils which are separated from adjacent abutting pairs of reactive coils by barriers of inert coils; the reactive coils may be coils of shock tube and the inert coils may be coils of insulated electric transmission wires; and the barriers of inert coils may be substantially coextensive with the reactive coils.

Another aspect of the present invention provides for the reactive coils to have a reactive coil length and reactive coil width and for the inert coils to have an inert coil length and an inert coil width, the inert coil length being not greater than about one-half of the reactive coil length, and the inert coil width being about the same as the reactive coil width, and wherein respective ones of the inert coils are removably secured to respective ones of the reactive coils so as to form mixed coil pairs and leave a portion of the length of the reactive coil of a given mixed coil pair uncovered by the inert coil to which it is secured, and adjacent mixed coil pairs are nested within the container to dispose the inert coils of adjacent mixed coil pairs in alignment with each other whereby to provide barriers of inert coils which extend between their associated reactive coils for about the entire length of the reactive coils. Related features of the this aspect of the present invention include one or more of the following features: the inert coil length may be about one-half of the reactive coil length and the barriers may each be comprised of two aligned inert coils; and the mixed coil pairs may be disposed within the container in a configuration wherein the reactive coils and the inert coil barriers are disposed in a single or repeating pattern of: (1) reactive coil, (2) inert coil barrier, (3) reactive coil, (4) reactive coil, (5) inert coil barrier, (6) reactive coil.

In accordance with a method aspect of the present invention, there is provided a method of packaging within a container a plurality of first detonator devices comprising detonators having reactive coils attached thereto and second detonator devices comprising detonators having inert coils attached thereto, the method comprising: interleaving inert coils between at least some of the reactive coils to provide a barrier of inert coils between at least some of the reactive coils.

In another method aspect of the present invention, the reactive coils have a reactive coil length and reactive coil width and the inert coils have an inert coil length and an inert coil width, the inert coil length being not greater than about one-half of the reactive coil length, and the inert coil width being about the same as the reactive coil width, the method further comprising removably securing respective ones of the inert coils to respective ones of the reactive coils, leaving a portion of the length of the reactive coils uncovered by their associated inert coils to thereby form a mixed coil pair, and nesting adjacent mixed coil pairs within the container to dispose the inert coils of adjacent mixed coil pairs in alignment with each other, whereby the resulting barriers of inert coils extend between their associated reactive coils for about the entire length of the reactive coils. Related method aspects of the invention include one or more of the following features: the inert coil length may be about one-half of the reactive coil length and one inert coil is removably secured at one end of a reactive coil to leave about one-half of the reactive coil exposed, and the resulting mixed coil pairs are nested to form barriers consisting of two aligned inert coils; and the mixed coil pairs may be packed within the container in a single or repeating pattern of: (1) reactive coil, (2) inert coil barrier, (3) reactive coil, (4) reactive coil, (5) inert coil barrier, (6) reactive coil.

Desirably, the coiled inert leads, e.g., electric leg wires, are disposed approximately coextensively with the coiled reactive leads, e.g., shock tube or safety fuse leads.

DETAILED DESCRIPTION OF THE INVENTION AND SPECIFIC EMBODIMENTS THEREOF

Figure 1:
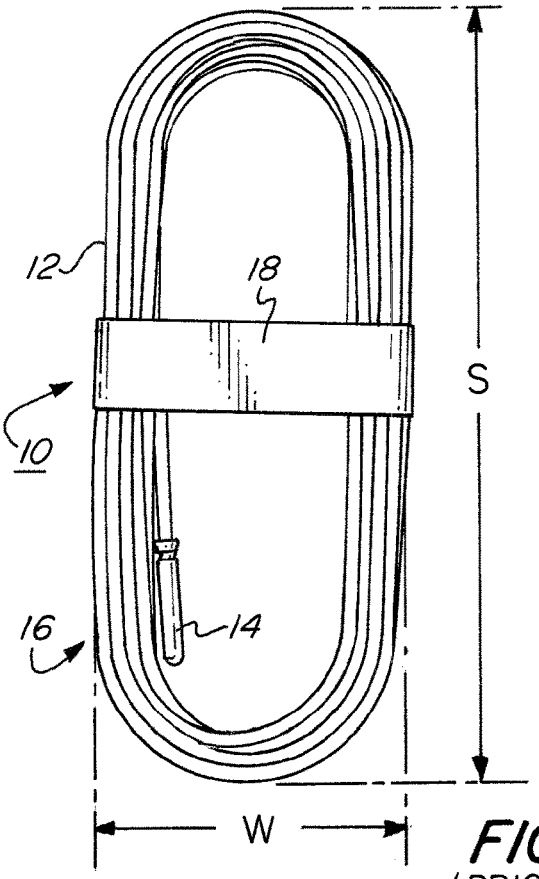
FIG. 1 (PRIOR ART)
FIG. 1 is a plan view of a conventional shock tube detonator device, with the shock tube coiled.

The detonator devices contemplated for packaging in accordance with the present invention generally comprise non-electric detonators having reactive leads and electric detonators having inert leads. Both types are usable for detonating borehole explosives in blasting or mining operations and are often used together. The following description is specific to the electric detonators having electric-conducting leg wires and non-electric detonators having shock tube leads. It should, however, be understood that the present invention is not limited to the illustrated and described specific embodiment. For example, while the current state of the art utilizes electrically-conductive wires for electric detonators, it is conceivable that at some future point other types of inert leads, such as fiber optic strands, may find a similar use. Similarly, while the current technology provides shock tube and safety fuse as the reactive leads or fuses for non-electric detonators, it is conceivable that some other type of reactive fuse may in the future be developed for the same use.

Shock tube, as is known in the art, is an extruded tube of polymer material having a hollow core and a relatively small quantity of explosive material, e.g., HMX, in powder form, and ultrafine aluminum powder, disposed on the inner wall of the tube. As used herein and in the claims, "shock tube" is meant to include any suitable detonation signal transmission tube of this type, including low velocity signal transmission tube, or the like. Electric detonators are fired by an electrical current passed through the insulated leg wires of the electric detonators. The leg wires, unlike the shock tube, contain no explosive or reactive energetic material and for this reason the coils thereof are referred to herein as inert coils.

In a specific embodiment, the present invention packages in the same container electric detonator devices having wire leg leads, the electric detonators optionally containing electronic delay timing mechanisms, and non-electric detonator devices having shock tube or safety fuse reactive leads, the non-electric detonators optionally containing electronic delay timing mechanisms. The leg wires of the electric detonator devices and the shock tube or safety fuse leads of the non-electric detonators are coiled. The electric leg wire coils are interposed between the shock tube or safety fuse coils, so that the coiled electric leg wires serve to interrupt, or at least increase the chance of interrupting, propagation from one coil of shock tube or safety fuse to another, of a reaction started by accidental initiation of a detonator within the container.

An aspect of the present invention provides for the packaging system to utilize individual electric detonator devices having their leg wires disposed in a coiled configuration ("coiled electric detonator devices") and individual non-electric detonator devices having their reactive leads, e.g., shock tube or safety fuse leads, disposed in a coiled configuration ("coiled reactive lead detonator devices"). The coiled electric detonator devices are disposed between the coiled reactive lead detonator devices so that the leg wire coils separate the reactive lead coils from each other.

Another aspect of the present invention provides for the packaging system to comprise groups (two or more) of coiled electric detonator devices disposed between groups (two or more) of coiled reactive lead detonator devices so that the groups of inert coils separate the groups of reactive lead coils from each other.

FIG. 1 shows a first detonator device comprising in the illustrated embodiment a shock tube detonator device 10 comprised of a length of shock tube 12 having a detonator 14 at one end thereof. The other end of shock tube 12 (not shown) is sealed to close off the tube interior as is well known in the art. As is conventional, for packing and shipping, shock tube 12 is formed into an elongate, somewhat ovoid-shaped coil 16 which is held in place by a readily removable retainer band 18. The length of the long dimension of coil 16 is indicated by dimension arrow S and the width of the small dimension of coil 16 is indicated by the dimension arrow W. The shock tube 12 may be coiled in a "figure of 80" pattern as described in U.S. Pat. No. 5,129,514 to Lilley, Jr. dated Jul. 14, 1992. However, any suitable coiling pattern may be employed. It will be appreciated that in use, retainer band 18 is removed and shock tube 12 is uncoiled and played out to the desired length, as is the electric leg wire 22 (FIG. 2) of inert coil 26. Detonator 14 may be any suitable type of detonator which is initiated by an initiation signal generated in shock tube 12. The explosive ends of detonators 14 (and of detonators 24 described below) may be encapsulated by a protective end cap (not shown) that serves to attenuate the force of the explosion generated by accidental initiation of a detonator. Such devices comprise a tube of inert material such as wood, synthetic plastic polymer or dense cardboard closed at one end and having a bore formed in it so that the device can be slipped over the explosive end of a detonator. Such devices are well known in the art and inclusion of them is not essential to the practices of the present invention. However, such protective end caps can be useful in helping to attain a better shipping classification for packages in accordance with the present invention.

The shock tube 12 of a typical shock tube detonator device 10 may of course be of any suitable length, but will usually range from about 8 to 180 feet (from about 2.4 to 55 meters) and may contain a mixture of HMX and aluminum in an amount, for example, of about 0.016 grams per meter. As is well known, shock tube may be initiated not only by an intense spark delivered to the interior of the tube to ignite the reactive material therein, but by detonation of a detonator in close proximity to, for example, in abutting contact with, the exterior of the shock tube. In either case, generation of an initiation signal in the shock tube will travel to and detonate the detonator to which the shock tube is attached as a fuse. Therefore, accidental detonation of a single detonator in a package containing a plurality of shock tube detonator devices can set off a chain reaction among the shock tube detonator devices in the package.

Figure 2:
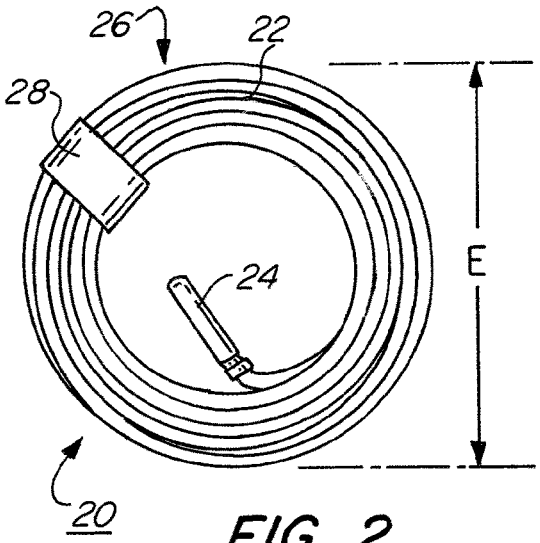
FIG. 2 (PRIOR ART)
FIG. 2 is a plan view of a conventional electric wire detonator device with the electric leg wires coiled.

FIG. 2 shows an electric detonator device 20 comprising insulated electric leg wire 22, one end of which is connected to an electric detonator 24. The other end of wire 22 is adapted to be connected to a source of electrical energy to be transmitted through wire 22 to initiate electric detonator 24. Electric leg wire 22 is formed into a substantially circular coil 26 which is held in place by a readily removable retainer band 28. However, any suitable coiling pattern may be employed. The diameter of coil 26 is indicated by the dimension arrow E. In use, retainer band 28 is removed and electric leg wire 22 is uncoiled and played out to the desired length. Electric leg wire 22 comprises a pair of electrically conductive wires contained within an electrically insulating material and insulated from each other, much like a household electric cord. The length of the electric leg wires 22 may of course be any suitable length but will usually range from about 30 feet to 180 feet (from about 9 meters to 55 meters).

Figure 3:
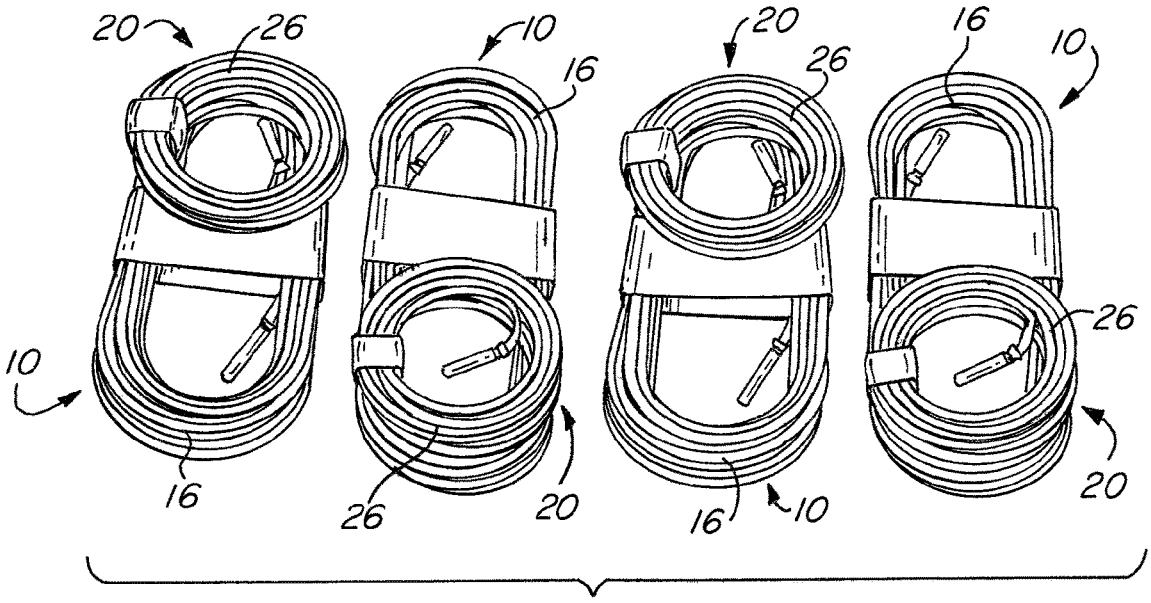
FIG. 3 is a perspective view of a plurality of the coiled shock tube and coiled electric wire detonator devices of, respectively, FIGS. 1 and 2, with individual coiled electric wire detonator devices positioned on respective coiled shock tube detonator devices prior to tying one respective shock tube detonator device to one respective electric wire detonator to form mixed coil pairs in accordance with an embodiment of the present invention.
Figure 4:
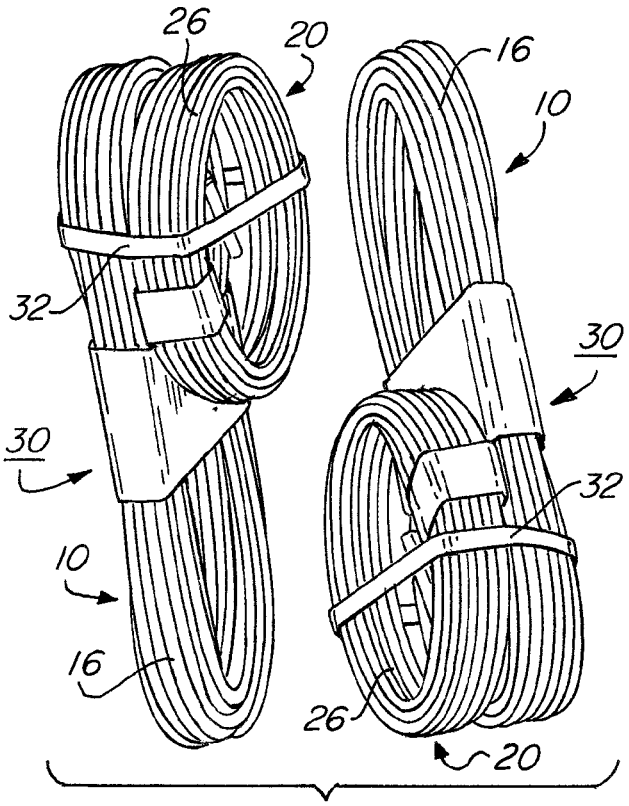
FIG. 4 is a perspective view of two mixed coil pairs positioned adjacent to each other prior to being nested together.
Figure 5:
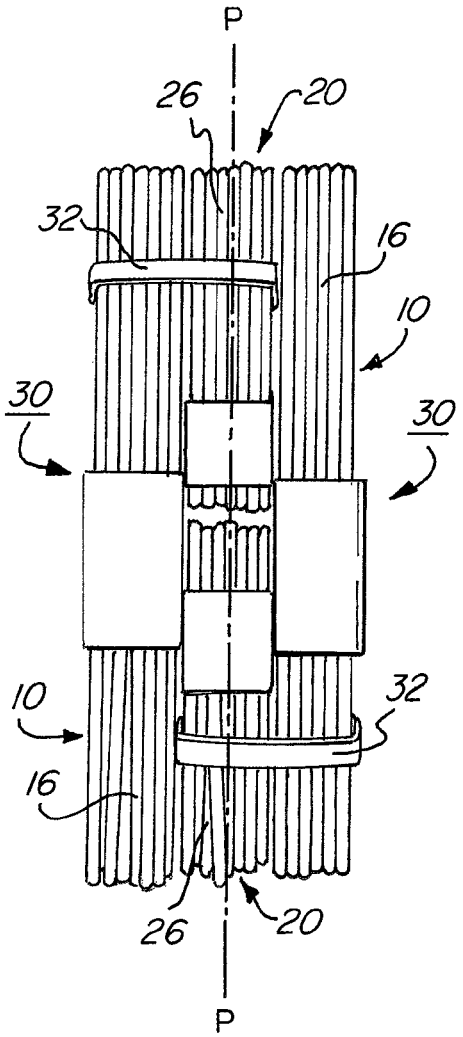
FIG. 5 is a perspective view of the two mixed coil pairs of FIG. 4 nested together in abutting contact with each other in accordance with one embodiment of the present invention.
Figure 5A:
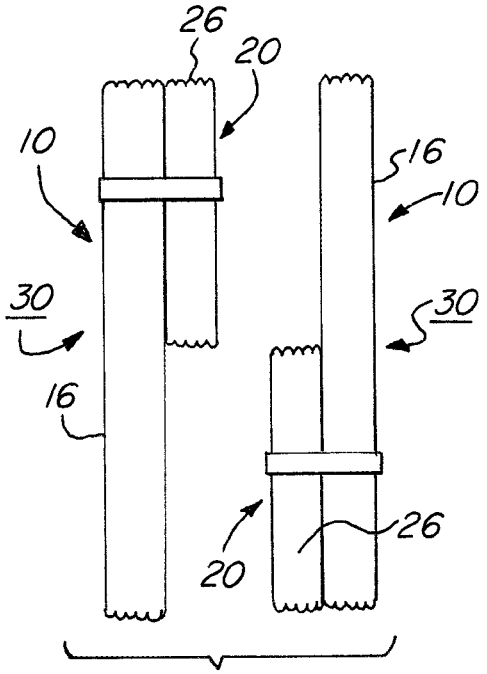
FIG. 5A is an exploded, schematic view of the two mixed coil pairs of FIG. 5.

FIGS. 3 and 4 show a plurality of reactive coils 16 (shock tube coils in the illustrated embodiment) and inert coils 26 (electric leg wire coils in the illustrated embodiment) positioned to provided mixed coil pairs 30 which each comprise, as illustrated in FIG. 4, a coiled shock tube detonator device 10 secured by a tie band 32 to a coiled electric detonator device 20. Retainer bands 18 and 28 and tie bands 32 may be made of paper, cardboard, plastic or the like and may readily be removed, usually by tearing or cutting them. It is desirable to position the shock tube coil 16 and electric leg wire coils 26 so that their respective detonators 14, 24 (FIGS. 1 and 2) are not adjacent each other but are positioned in staggered relationship to keep as much distance as possible between adjacent detonators. The diameter E (FIG. 2) of the coiled electric detonator devices 20 is approximately one-half the length S (FIG. 1) of the coiled shock tube detonator devices 10. The first mixed coil pair 30 is placed adjacent to a second mixed coil pair 30 as illustrated in FIG. 4. The two coil pairs may, as illustrated in FIG. 5, be placed in abutting nesting contact with each other with the electric leg wire coils 26 interposed between the shock tube coils 16, the two inert electric leg wire coils 26 being approximately co-extensive with the adjacent reactive shock tube coils 16. The schematic exploded view of FIG. 5A shows the two mixed coil pairs 30 of FIG. 5 spaced apart from each other for enhanced clarity of illustration. Each of the mixed coil pairs 30 as described above, is comprised of reactive coil 16 and an inert coil 26.

Figure 6:
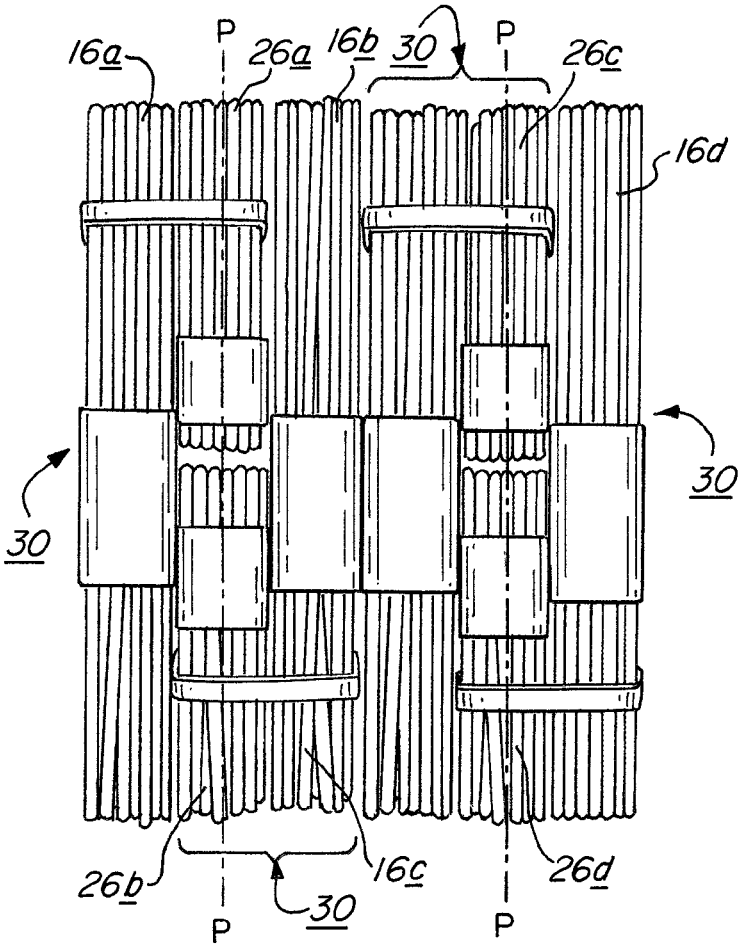
FIG. 6 is a perspective view of four of the coiled pairs of FIG. 4 disposed in nesting abutting contact with each other in accordance with an embodiment of the present invention.
Figure 6A:
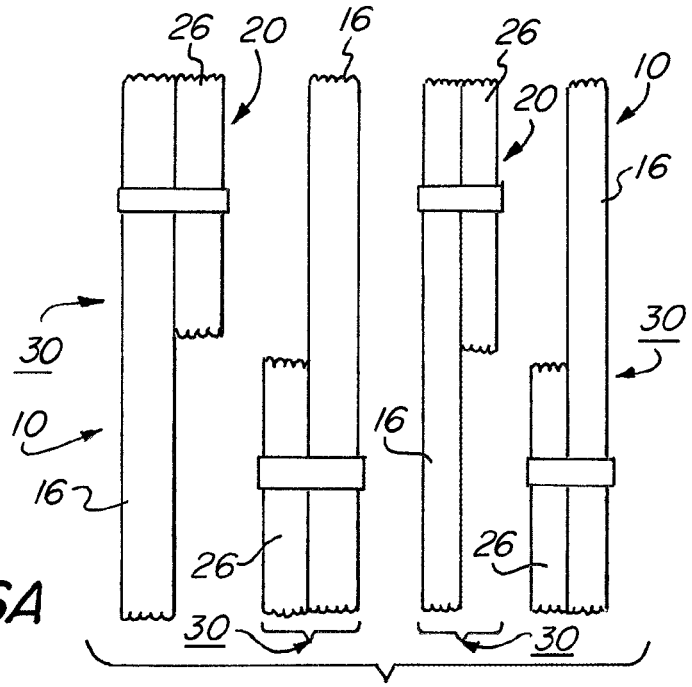
FIG. 6A is an exploded, schematic view of the mixed coil pairs of FIG. 6.

FIG. 6 shows four mixed coil pairs 30 disposed in nesting abutting contact with each other. By "nesting" contact it is meant that the profiles of adjacent mixed coil pairs 30 are essentially congruent to each other as shown, for example, in FIGS. 5 and 6, with aligned inert electric leg wire coils 26 lying in the same plane P. The identical reactive coils are numbered as 16*a*, 16*b*, 16*c* and 16*d* in FIG. 6 and the identical inert coils are numbered 26*a*, 26*b* and 26*c*, 26*d*. It is seen that in this type of repeating arrangement, reactive coils 16*b* and 16*c* are unavoidably positioned adjacent to each other, in fact, in abutting contact with each other. As discussed elsewhere herein, an insert of inert material, such as a heavy corrugated board, could be inserted between reactive coils 16*b* and 16*c*, although that may not be necessary. FIG. 6 shows a repeating pattern, from left to right as viewed in FIG. 6, of a reactive coil 16*a*, aligned inert coils 26*a* and 26*b*, reactive coil 16*b*, reactive coil 16*c*, aligned inert coils 26*c*, 26*d*, and reactive coil 16*d*. The schematic exploded view of FIG. 6A shows the four mixed coil pairs 30 of FIG. 6 spaced apart from each other for enhanced clarity of illustration. The pattern of FIG. 6 is repeated in the mixed coil pairs 30 disposed in a container 34 of FIG. 7.

Figure 7:
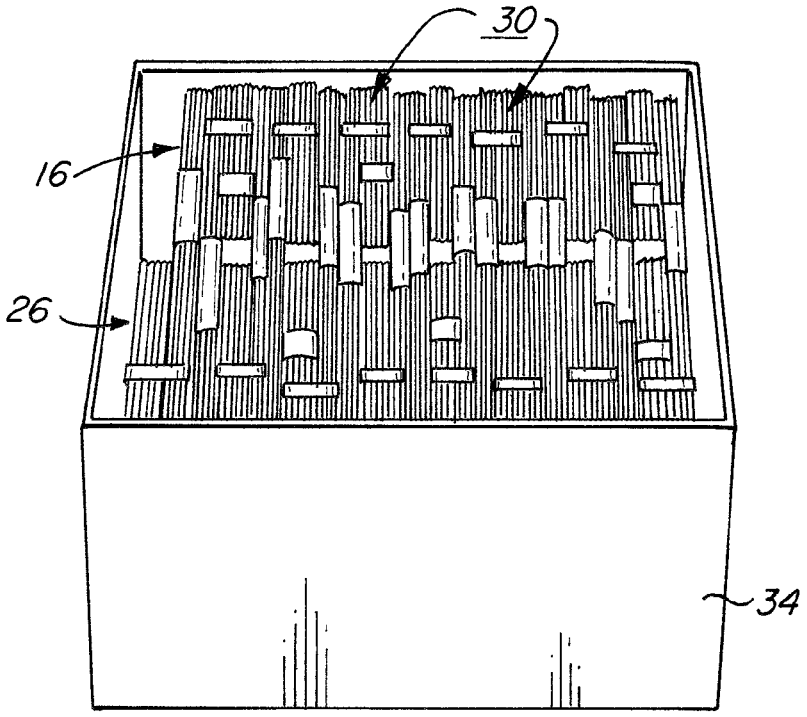
FIG. 7 is a perspective view of a plurality of the mixed coil pairs of FIG. 4 nested in abutting contact with each other in a container.
Figure 8:
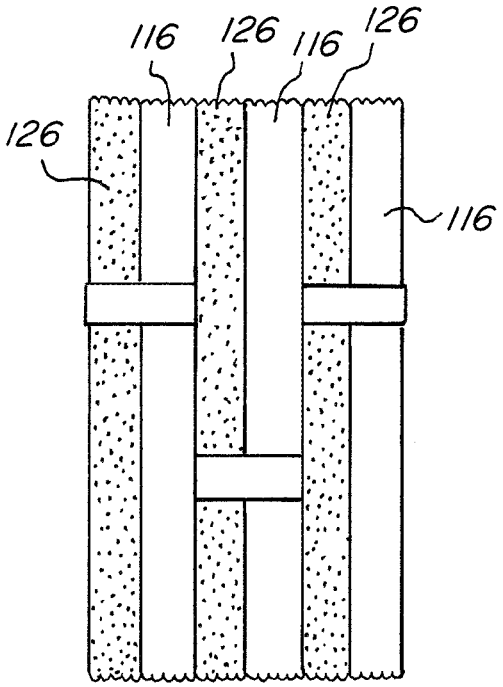
FIG. 8 is a schematic view of an arrangement of reactive and inert coils in accordance with another embodiment of the present invention.

As shown in FIG. 7, a plurality of the mixed coil pairs 30 are disposed in container 34, with each set of two reactive shock tube coils 16 separated from other reactive shock tube coils 16 by paired electric leg wire coils 26. If a detonator should accidentally be initiated, the electric leg wire coils 26 will act as a barrier to ignition spreading beyond more than two adjacent shock tube coils 16. FIG. 8 schematically shows another embodiment of the present invention in which reactive coils 116 are of substantially identical size as inert coils 126 and therefore the nesting configuration is not required. This embodiment permits an arrangement in which no reactive shock tube coils 116 need be positioned in abutting contact, as is the case with the embodiment of FIG. 6.

In addition to the safety feature provided by utilizing the electric leg wire coils as barriers to propagation of initiation signals from one shock tube detonator coil to another, the packaging system of the present invention has the added advantage of providing in a single container both shock tube and electric detonator devices. These two types of detonator devices are often used in conjunction with each other, usually in a one-to-one ratio, in "hybrid" blasting schemes which utilize both shock tube detonator devices and electric wire detonator devices. Further, the lengths of shock tube 12 and electric leg wires 22 of the respective detonator devices 10, 20 which are packed in a single container may be selected to be approximately equal to each other, to facilitate installation in such "hybrid" blasting schemes.

The container in which the shock tube and electric detonator devices are packed may comprise corrugated board and as an added safety measure corrugated board divider barriers may be interspersed between some of the detonator devices and elsewhere in the container in which the detonator devices 10, 20 are packed. For example, one or more of the sides, top and bottom of container 34 of FIG. 7 may be lined with inert barrier material. The materials used to produce the containers or divider barriers may be made from any suitable material although corrugated board is usually employed. In addition to the foregoing, it is optional to place coil pairs of shock tube and electric detonator devices, or groups of such paired detonator devices, in sealed moisture barrier bags and place the bags within the container. The moisture barrier bags may be made from polymer-metal foil laminate material and the bags and/or the container may contain desiccant to absorb moisture that may enter the container over long-term storage. This will preclude or reduce the adverse effect of moisture on performance of the detonator devices.

While the invention has been described in detail with reference to specific embodiments, it will be appreciated that numerous variations may be made to the described embodiment, which variations nonetheless lie within the scope of the present invention.

The invention claimed is:

1. A packaging system comprising a container within which are disposed a plurality of first detonator devices comprising detonators having reactive coils attached thereto, and a plurality of second detonator devices comprising detonators having inert coils attached thereto; the first and second detonator devices being disposed within the container so that at least some of the reactive coils have interposed between them inert coils, the inert coils thereby providing barriers of inert coils between at least some of the reactive coils, wherein the reactive coils have a reactive coil length and reactive coil width and the inert coils have an inert coil length and an inert coil width, the inert coil length being not greater than about one-half of the reactive coil length, and the inert coil width being about the same as the reactive coil width, wherein respective ones of the inert coils are removably secured to respective ones of the reactive coils so as to form mixed coil pairs and leave a portion of the length of the reactive coil of a given mixed coil pair uncovered by the inert coil to which it is secured, and adjacent mixed coil pairs are nested within the container to dispose the inert coils of adjacent mixed coil pairs in alignment with each other whereby to provide barriers of inert coils which extend between their associated reactive coils for about the entire length of the reactive coils.

2. The packaging system of claim 1 wherein the inert coil length is about one-half of the reactive coil length and the barriers are each comprised of two aligned inert coils.

3. The packaging system of claim 1 wherein the mixed coil pairs are disposed within the container in a configuration wherein the reactive coils and the inert coil barriers are disposed in a single or repeating pattern of: (1) reactive coil, (2) inert coil barrier, (3) reactive coil, (4) reactive coil, (5) inert coil barrier, (6) reactive coil.

* * * * *